United States Patent [19]

Nestor

[11] 4,325,600

[45] Apr. 20, 1982

[54] PIGTAIL ASSEMBLY

[75] Inventor: Charles R. Nestor, Niles, Ohio

[73] Assignee: General Motors Corporation, Detroit, Mich.

[21] Appl. No.: 127,870

[22] Filed: Mar. 6, 1980

[51] Int. Cl.[3] ..... H01R 13/52

[52] U.S. Cl. ..... 339/116 C; 339/94 M; 339/82 R

[58] Field of Search ..... 174/74 A, 77 S; 339/182 R, 26, 145 T, 197 R, 94 R, 94 M, 217 S, 116 C

[56] References Cited

U.S. PATENT DOCUMENTS 3,573,709 4/1971 Elliott ..... 339/26 R 4,241,971 12/1980 Leonard et al. ..... 339/182 R X

*Primary Examiner*—Eugene F. Desmond

*Attorney, Agent, or Firm*—F. J. Fodale

[57] ABSTRACT

A pigtail assembly has four insulated lead wires with terminals for attachment to a heated oxygen sensor post terminal. An insulator sleeve is slidably mounted on a central lead wire and has external guide holes for circumferentially spacing the three remaining lead wires and the three terminals attached thereto. The insulator sleeve also has two slots and a rib which cooperate in assuring proper seating and/or spacing of the three terminals. One of the three terminals has outwardly projecting lock tabs for holding a splash guard in place.

A second pigtail assembly has two insulated lead wires with terminals for attachment to a nonheated oxygen sensor post terminal. The insulator sleeve is mounted on one of the lead wires and has an external guide hole for the other lead wire and the terminal attached to it. The insulator sleeve has vent slots and the terminal attached to the other lead wire has outwardly projecting tabs for holding the splash guard in place.

4 Claims, 4 Drawing Figures

PIGTAIL ASSEMBLY

This invention relates generally to electric connectors and more particularly to a pigtail assembly which has a plurality of terminals which are to be welded to respective contacts of a post terminal.

U.S. patent application Ser. No. 072,089 filed Sept. 4, 1979, now U.S. Pat. No. 4,241,971 issued Dec. 30, 1980, and assigned to the assignee of this invention, discloses a pigtail assembly comprising an end connector having two lead wires extending therefrom. A terminal is attached to the free end of each lead wire. Each terminal has a clip-like contact appropriately sized for assembly to and retention on one of the two ring contacts of an oxygen sensor post terminal. After assembly, the clip-like contacts are welded to the respective ring contacts. The lead wire for the smaller terminal also slidably carries an insulator sleeve which is slid to a position isolating the smaller terminal after it is welded to its associated ring contact. The two lead wires also slidably carry a splash guard which is slid down the two lead wires to cover the two terminals after they are welded to the ring contacts and the insulator sleeve is in place.

The object of the invention is to improve upon the arrangement described above.

One feature of the invention resides in incorporating means in one of the terminals for preventing the splash guard from walking off the oxygen sensor due to vibrations which may be encountered in use.

Another feature resides in incorporating means in the insulator sleeve for restraining terminal vibration.

Yet another feature resides in shaping the insulator sleeve to assure that one or more of the terminals is properly seated prior to welding it to its associated ring contact.

Still yet another feature in connection with pigtail assemblies having at least three terminals resides in incorporating means in the insulator sleeve for locating the larger terminals in a proper spaced relationship for each other.

Other objects and features of the invention will become apparent to those skilled in the art as the disclosure is made in the following detailed description of a preferred embodiment of the invention as illustrated in the accompanying sheet of drawing in which.

Figure 1:
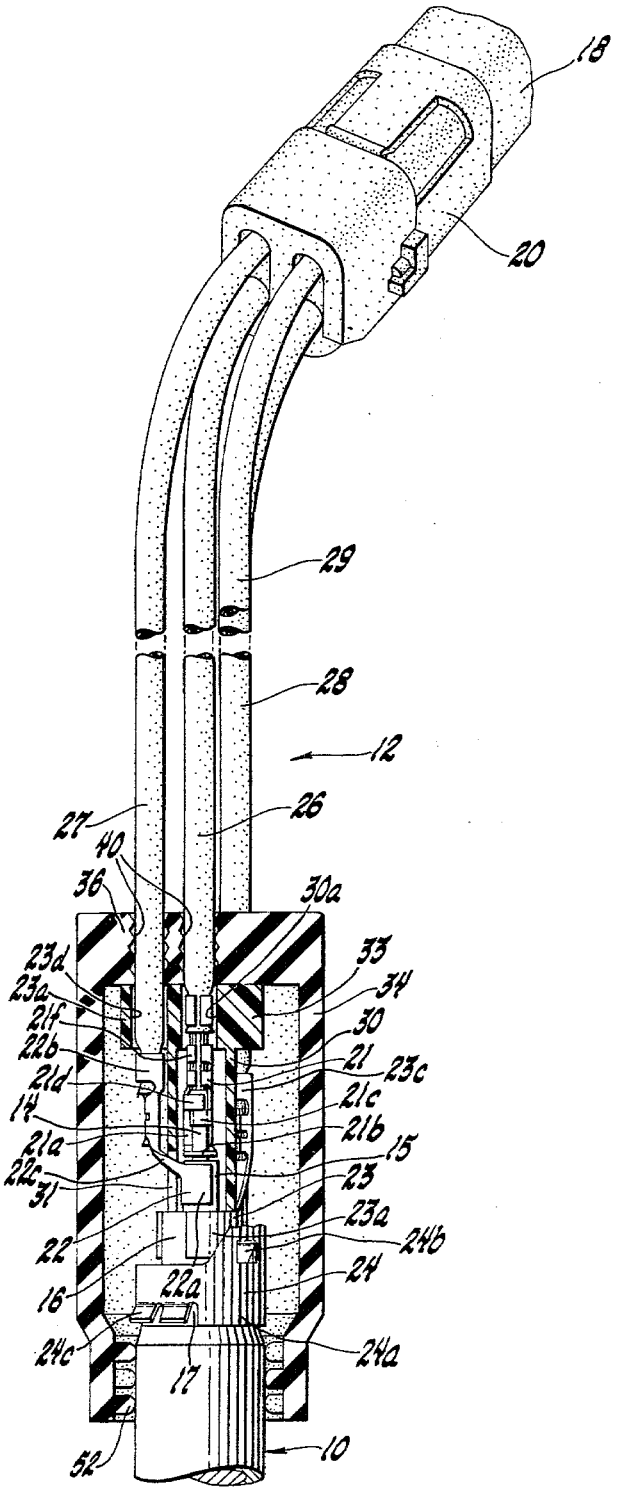
FIG. 1 is a partially sectioned, partially perspective, view showing a pigtail assembly embodying the invention attached to an oxygen sensor post terminal.

Referring now to the drawing and more particularly to FIG. 1, an oxygen sensor 10 i represented by a schematic post terminal portion to which is permanently attached a pigtail assembly 12. The oxygen sensor 10 is a device which detects the amount of oxygen in the exhaust gases of an internal combustion engine or the like by means of an electrode which is exposed to the exhaust gases on one side and to ambient air on the other side. The electrode generates a signal representative of the relative concentrations of oxygen in the ambient air and exhaust gases. The generated signal is used to control the fuel-air ratio of the combustible mixture for the internal combustion engine. In some instances, the oxygen sensor is heated.

The oxygen sensor 10 is of the heated type and consequently it has a post terminal which has four concentric longitudinally spaced ring contacts 14, 15, 16 and 17 of successively increased diameters. The smallest diameter contact 14, in the form of a solid pin, and the contact 15 are for the heater element (not shown). The contact 16 is the upper end of a tube which is electrically connected to the air side of the electrode (not shown) and which is spaced from an upper metal shield to provide a passage for ambient air to reach the air side of the electrode. The largest diameter contact 17 is a reduced upper end of the upper metal shield of the oxygen sensor 10. The shield is electrically connected to the exhaust gas side of the electrode and provides a second ground.

Further details of the oxygen sensor 10 and its post terminal are not necessary for an understanding of this invention. As a matter of general interest, U.S. Pat. No. 4,169,778, granted to Gamdur S. Mann et al on Oct. 2, 1979, shows an oxygen sensor to which the pigtail assembly 12 can be attached.

The pigtail assembly 12 serves to connect the ring contacts 14, 15, 16 and 17 to an electric circuit via a suitable wiring harness represented by an end connector 18 which mates with a suitable end connector 20 of the pigtail assembly 12. Specific construction details of the end connector 20 and its mating connector 18 are not per se a part of this invention. However, pending U.S. patent application Ser. No. 953,410 filed Oct. 23, 1978 for a "Weatherproof Electrical Connector" discloses construction details of connectors which we have found useful for attaching a pigtail assembly to a wiring harness, particularly in the case of a pigtail assembly for an oxygen sensor.

The pigtail assembly 12 is attached to the oxygen sensor 10 by a female terminal 21 and snap-on terminals 22, 23 and 24 secured to the ends of the respective insulated lead wires 26, 27, 28 and 29 leading out of the end connector 20. The female terminal 21 is the subject of copending U.S. patent application Ser. No. 116,039, filed Jan. 28, 1980. It comprises a floor portion 21*a* having an apertured transverse wall 21*b* at one end which receives the pin contact 14. The floor portion 21*a* has two integrally attached flaps 21*c* and 21*d*. The flap 21*c* acts as a spring clip which engages the end of the pin contact 14 and biases the pin contact 14 against a projection 21*e* of the floor portion 21*a*. The flap 21*d* acts as a stop which limits insertion of the pin contact 14. The female terminal 21 has an attachment portion 21*f* comprising core and insulation crimp wings secured to the lead wire 26. The core crimp wings are preferably slotted and the lead wire core is preferably laser welded to the female terminal 21 at this location.

The snap-on terminal 22 has a clip-like, C-shaped contact 22*a* which is designed so that it expands over the ring contact 15 and snaps into a retained position thereon. The terminal 22*a* has an attachment portion 22*b* similar to that of the female terminal 21, attached to lead wire 27. The attachment portion 22*b* is offset from the contact portion 22*a* by neck 22*c*.

The snap-on terminal 23 also has a C-shaped contact 23*a*. The C-shaped contact 23*a*, however, is designed for longitudinal assembly to the ring contact 16 and has a porportionately smaller opening than the contact 22*a*. The contact 23*a* is oval-shaped and the opening is located on the minor diameter. The terminal 23 has a bent tab 23*b* at the base of the contact 23*a* which serves as a stop to properly position the contact 23*a* on the ring contact 16 in the longitudinal direction. The snap-on terminal 23 also has an attachment portion 23*c* attached to lead wire 28.

The snap-on terminal 24 also has a longitudinally assembled C-shaped contact 24*a* which is oval-shaped and a bent tab 24*b* at the base of the contact 24*a* for longitudinal positioning. The contact 24*a* is larger than the contact 23*a* but its proportions are the same. The contact 24*a* includes four outwardly projecting lock tabs 24*c* at its lower end. The terminal 24 is attached to lead wire 29 by an attachment portion 24*d* constructed like those of the other three terminals.

The lead wire 26 carrying the female terminal 21 slidably carries an insulator sleeve 30 by means of a central guide hole 30*a*. The insulator sleeve 30 may be made of any suitable high temperature resistant, electric insulation material. An example of a suitable material is Ryton, a phenolic thermoplastic material produced by Phillips Chemical Co. The lower end of the insulator sleeve 30 has two slots 31 and 32 which are spaced apart 120° and cooperate with terminals 22 and 23 respectively. Specifically, the slot 31 fits over the neck 22*c* of terminal 22 and the slot 32 fits over the tab 23*c* of terminal 23 when the insulator sleeve 30 is in the seated position shown in FIG. 1.

The insulator sleeve 30 also has an integral radial boss 33 at its upper end, which in this instance is in the form of three, equally circumferentially spaced, projections 33*a*, 33*b* and 33*c* which provide three equally circumferentially spaced guide holes 33*d*, 33*e* and 33*f* for the wire leads 27, 28 and 29. The guide hole 33*d* and slot 31 are longitudinally aligned and so are the guide hole 33*e* and slot 32. The insulator sleeve 30 also has a radially projecting longitudinal rib 33*g* which is beneath the projection 33*c* and to the side of the guide hole 33*f* toward the guide hole 33*e*.

The height of the insulator sleeve 30 is preferably such that, when it is in the seated position shown in FIG. 1, the insulator sleeve 30 serves as a stop to properly position a splash guard 34. The splash guard 34 is generally the same as that disclosed in the aforementioned pending U.S. patent application Ser. No. 072,089 except that the grommet and boot are molded as one piece. The splash guard, however, is still preferably made of silicone material. The top wall 36 of the splash guard 34 has four round passages 40 for slidably mounting the splash guard 34 on the insulated lead wires 26, 27, 28 and 29. The four round passages 40 have the same pattern as the guide holes 30*a*, 33*d*, 33*e* and 33*f* and are internally ribbed for sealing engagement with the lead wires. The lower end of the splash guard 34 has internal sealing ribs 52 which engage the upper metal shield of the oxygen sensor 10 below the reduced upper end which provides the ring contact 17. The sealing ribs 52 are interrupted at different locations to provide an indirect vent path to the interior of the splash guard 34. The splash guard 34 is assembled on the four insulated lead wires so that the insulator sleeve 30 is slidably mounted on the insulated lead wires between the top wall 36 of the splash guard 34 and the terminals 21, 22, 23 and 24.

Figure 2:
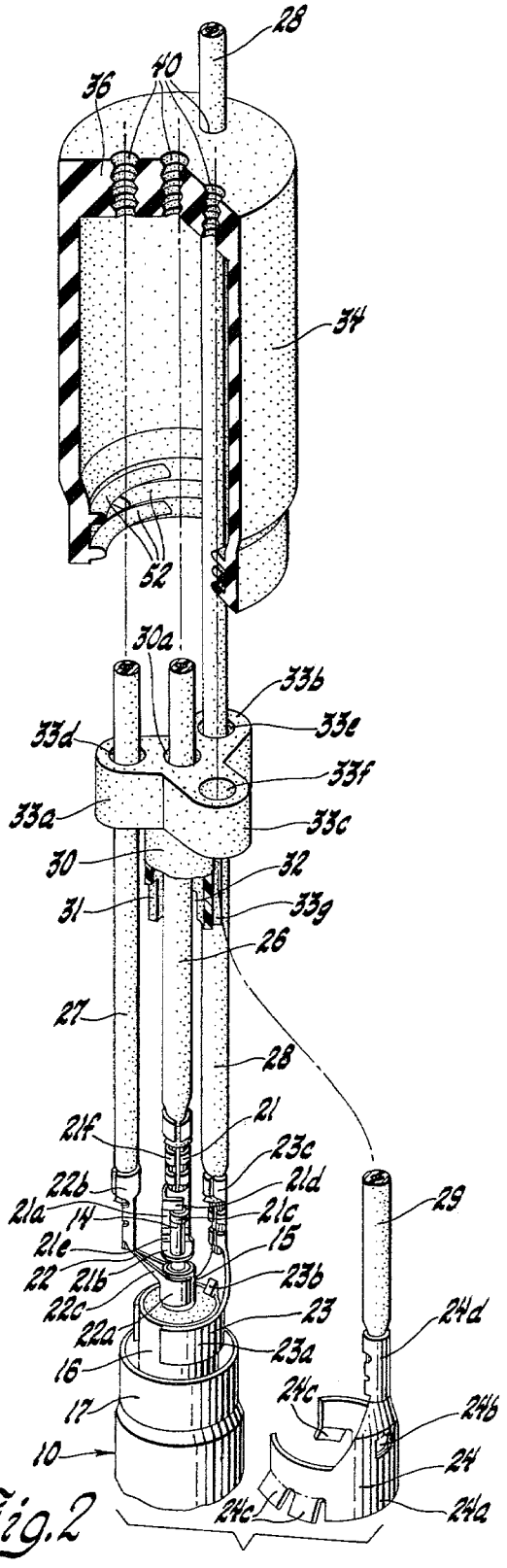
FIG. 2 is a partially sectioned, partially perspective, view showing the pigtail assembly of FIG. 1 in the process of being attached to the post terminal.

To commence assembly of the pigtail assembly 12 to the oxygen sensor 10, the insulator sleeve 30 and splash guard 34 are raised to non-interfering positions such as shown in FIG. 2.

The female terminal 21 is then assembled to the ring contact 14 (which is in the form of a solid pin), and permanently secured to the ring contact 14, preferably by resistence welding at the projection 21*e*. The snap-on terminals 22, 23 and 24 are then assembled to the respective ring contacts 15, 16 and 17 so that their respective attachment portions 22*b*, 23*c* and 24*d* and attached lead wires 27, 28 and 29 are equally circumferentially spaced. The insulator sleeve 30 is then slid down the lead wires to the position shown in FIG. 1 where the sleeve 30 seats on the insulation inside ring contact 16. The height of the slots 31 and 32 is such that proper seating of the insulator sleeve 30 insures that the terminal contacts 22*a* and 23*a* are properly seated on the ring contacts 15 and 16.

Seating of the insulator sleeve 30 also insures that the terminals 22, 23 and 24 are equally circumferentially spaced. Specifically terminal 22 is located by slot 31 and guide hole 33*d*, terminal 23 by slot 32 and guide hole 33*e* and terminal 24 by rib 33*g* and guide hole 33*f*. With the proper spacing assured by the seating of the insulator sleeve, the terminals 22, 23 and 24 are then permanently secured to the respective ring contacts 15, 16 and 17, preferably by laser welding the respective terminal contacts to the ring contacts while the insulator sleeve 30 is in the seated position shown in FIG. 1. In use, the seated insulator sleeve 30 isolates the female terminal 21 from the attachment portions of the other three terminals to prevent shorting between the terminals. The contact 22*a* of terminal 22 is also inside the insulator sleeve 30 but longitudinal spacing from the terminal 21 is assured by the top edge of the slot 31. Shorting between terminals 23 and 24 and the exterior portions of terminal 22 is prevented by the circumferential spacing provided by the insulator sleeve and the radial and longitudinal spacing of the contacts 23*a* and 24*a*.

The splash guard 34 is then lowered into the sealing position shown in FIG. 1 to protect the electrical connections made by the terminals 21, 22, 23 and 24 from dirt, water and other deleterious environmental matter. As pointed out earlier, the insulator sleeve 30 acts as a stop to properly position the splash guard 34. During assembly, the sealing ribs 52 ride over the outwardly projecting lock tabs 24*c* on the lower end of contact 24*a*. These lock tabs prevent the splash guard 34 from walking off the oxygen sensor shield responsive to vibrations which may be encountered during use.

Figure 3:
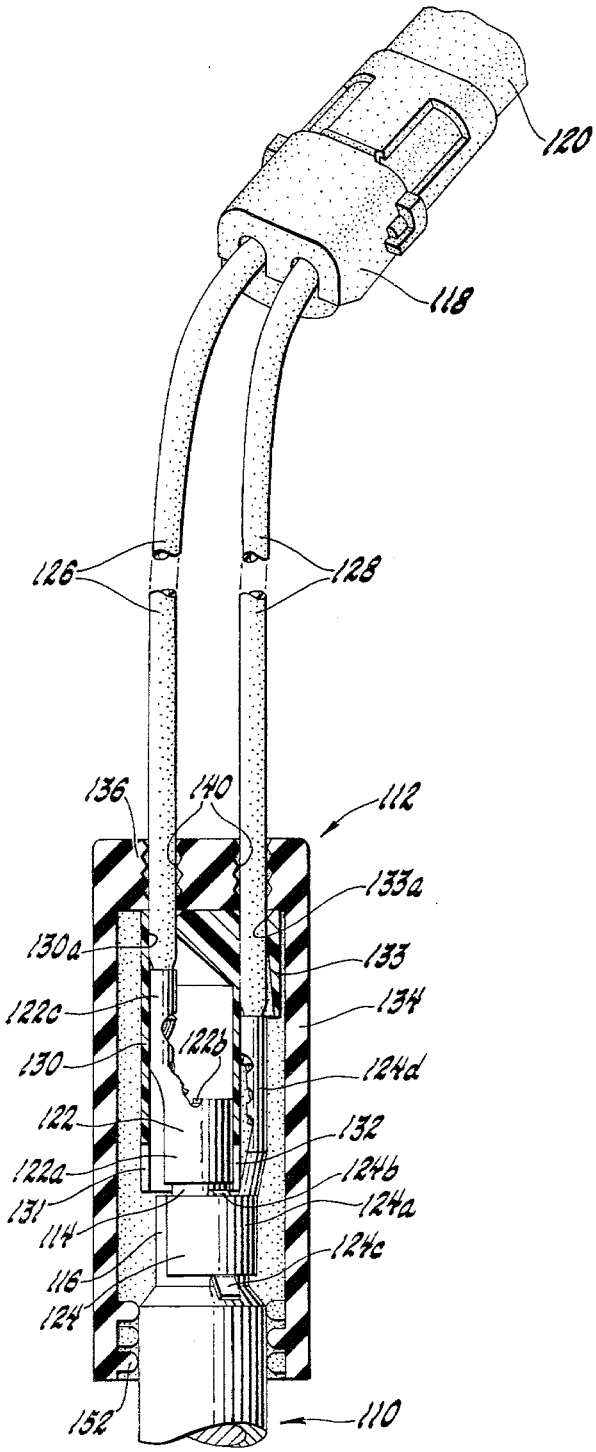
FIG. 3 is a partially sectioned, partially perspective, view showing a second embodiment of a pigtail assembly of this invention attached to an oxygen sensor post terminal.
Figure 4:
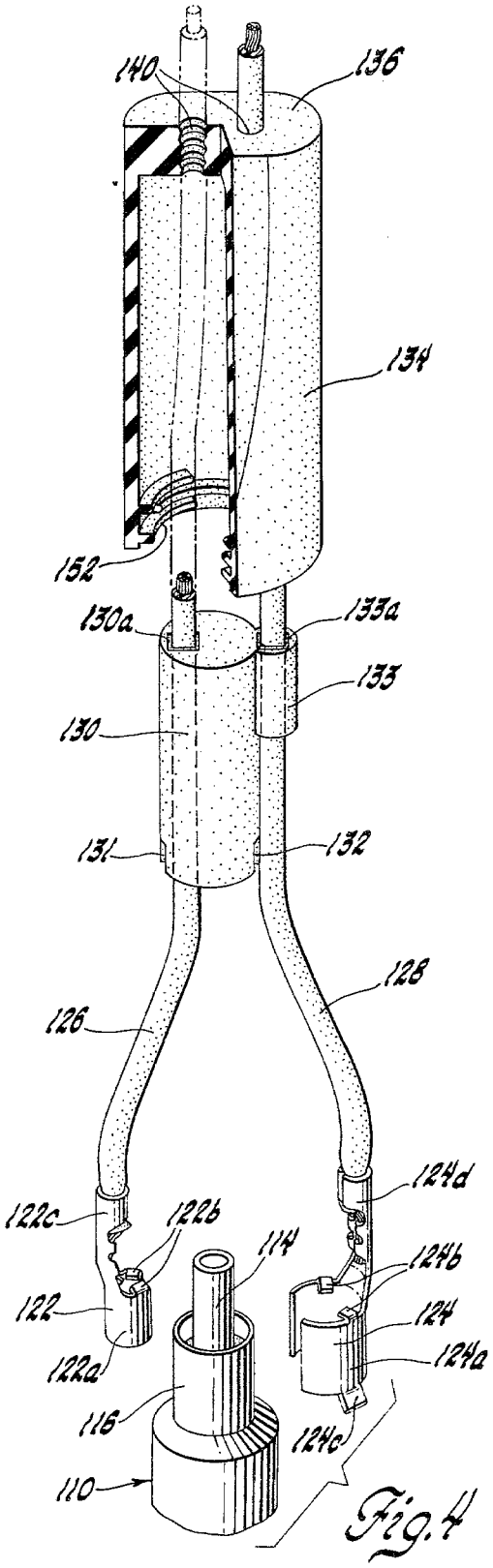
FIG. 4 is a partially sectioned, partially perspective, view showing the pigtail assembly of FIG. 3 in the process of being attached to the post terminal.

FIGS. 3 and 4 show an oxygen sensor 110 represented by a schematic post terminal portion to which is permanently attached a pigtail assembly 112 in accordance with a second embodiment of the invention. The oxygen sensor 110 is not of the heated type and consequently it has a post terminal which has only two concentric longitudinally spaced ring contacts 114 and 116 of successively increased diameters. The smaller diameter contact 114 is the upper end of a tube which is electrically connected to the air side of the oxygen sensor electrode (not shown) and which provides a passage for ambient air to reach the air side of the electrode. The larger diameter contact 116 is a reduced upper end of an upper metal shield of the oxygen sensor 110. The shield is electrically connected to the exhaust gas side of the electrode and provides a second ground. Further details of the oxygen sensor 110 and its post terminal are not necessary for an understanding of this modification of the invention.

The pigtail assembly 112 serves to connect the ring contacts 114 and 116 to an electric circuit via a suitable wiring harness represented by an end connector 118 which mates with a suitable end connector 120 of the pigtail assembly 112. As before, specific construction details of the end connector 120 and its mating connector 118 are not per se a part of this modification of the invention.

The pigtail assembly 112 is attached to the oxygen sensor 110 by snap-on terminals 122 and 124 secured to the ends of the respective insulated lead wires 126 and 128 leading out of the end connector 120.

The snap-on terminal 122 has a C-shaped contact **122*a* which is designed for longitudinal assembly to the ring contact 114. The contact 122*a* is oval-shaped and the opening is located on the minor diameter. The terminal 122 has a pair of bent tabs 122*b* at the upper edge of the contact 122*a* which serve as stops to properly position the contact 122*a* on the ring contact 114 in the longitudinal direction. The snap-on terminal 122 also has an attachment portion 122*c* comprising core and insulation crimp wings secured to lead wire 126. The core crimp wings are preferably slotted and the lead wire core is preferably laser welded to the snap-on terminal 122** at this location.

The snap-on terminal 124 also has a longitudinally assembled C-shaped contact **124*a* which is oval-shaped and bent tabs 124*b* at the upper edge of the contact 124*a* for longitudinal positioning. The contact 124*a* is larger than the contact 122*a* but its proportions are the same. The contact 124*a* includes a pair of two diametrically opposed, outwardly projecting lock tabs 124*c* at its lower edge. The terminal 124 is attached to lead wire 128 by an attachment portion 124*d* constructed like that of the terminal 122**.

The lead wire 126 carrying the terminal 122 slidably carries an insulator sleeve 130 by means of a guide hole **130*a* which opens into the interior of the sleeve. The insulator sleeve 130 may be made of any suitable high temperatures resistant, electric insulation material such as Ryton. The lower end of the insulator sleeve 130 has two diametrically opposed slots 131 and 132 which provide an air passage to the interior of the insulator sleeve 130 when the insulator sleeve 130 is in the seated position shown in FIG. 3. The insulator sleeve 130 has an integral radial boss 133 at its upper end which has a guide hole 133*a* for the wire lead 128**.

The height of the insulator sleeve 130 is preferably such that, when it is in the seated position shown in FIG. 1, the insulator sleeve 130 serves as a stop to properly position a splash guard 134. The splash guard 134 is generally the same as splash guard 34. That is, it is made of one piece construction preferably made of silicone material. The top wall 136 of the splash guard 134 however has two round internally ribbed passages 140 for slidably and sealingly mounting the splash guard 134 on the insulated lead wires 126 and 128. As before, the lower end of the splash guard 134 has internal sealing ribs 152 which engage the upper metal shield of the oxygen sensor 110 below the reduced upper end which provides the ring contact 116. The sealing ribs 152 are also interrupted at different locations to provide an indirect vent path to the interior of the splash guard 134. The splash guard 134 is assembled on the two insulated lead wires so that the insulator sleeve 130 is slidably mounted on the insulated lead wires between the top wall 136 of the splash guard 134 and the terminals 122 and 124.

The terminals 122 and 124 are assembled to the oxygen sensor 110 while the insulator sleeve 130 and splash guard 134 are in raised non-interfering positions as shown in FIG. 4.

The terminal 122 is then longitudinally assembled to the ring contact 114, and properly seated by the tabs **122*b*. The terminal 122 is then permanently secured to the ring contact 114** preferably by laser welding.

The snap-on terminal 124 is then assembled to the ring contact 116 and the insulator sleeve 130 is then slid down the lead wires 126 and 128 to the position shown in FIG. 3 where the sleeve 130 seats on the tabs **124*b* which in turn are seated on the upper edge of the ring contact 116. Thus proper seating of the insulator sleeve 130 insures that the terminal contact 124*a* is also properly seated. With the proper longitudinal spacing of the contacts 122*a* and 124*a* assured, the terminal 124 is then permanently secured to the ring contact 116 preferably by laser welding. In use, the seated insulator sleeve 130 isolates the terminal 122 from the terminal 124, particularly the attachment portion 124*d*, to prevent shorting between the terminals. Shorting between the contacts 122*a* and 124*a*** is prevented by their radial and longitudinal spacing.

The splash guard 134 is then lowered into the sealing position shown in FIG. 3 to protect the electrical connections made by the terminals 122 and 124 from dirt, water and other deleterious environmental matter. As before, the insulator sleeve 130 acts as a stop to properly position the splash guard 134 initially and the outwardly projecting lock tabs **124*c* on the lower edge of contact 124*a* prevent the splash guard 134 from walking off responsive to vibrations which may be encountered in use. In this regard, it is preferable that the sliding fit between the guide holes 130*a* and 133*a* of the insulator sleeve 130 and the respective lead wires 126 and 128 is rather snug so that the terminal attachment portions 122*c* and 124*d*** do not vibrate to any appreciable extent. This avoids possible terminal damage, particularly at the necks between the contacts and the attachment portions.

I wish it to be understood that I do not desire to be limited to the exact details of construction shown and described, for obvious modifications will occur to a person skilled in the art.

The embodiments of the invention in which an exclusive property or privilege is claimed are defined as follows:

1. In a pigtail assembly which includes an end connector having a plurality of insulated lead wires extending therefrom, a terminal attached to the end of each lead wire having a contact for assembly to and retention on a respective ring contact of a multiple ring contact post terminal, an insulator sleeve slidably mounted on a first of the lead wires for isolating the terminal attached to the first lead wire, and a splash guard slidably carried on the lead wires for covering the terminals after attachment to the post terminal, the improvement comprising said insulator sleeve having an integral radial boss adjacent an end of the insulator sleeve which is toward the end connector, said boss having a plurality of guide holes for the respective remaining lead wires, and said insulator sleeve having a pair of circumferentially spaced slots at an end opposite said boss, which are aligned with respective ones of said guide holes, said spaced slots cooperating with respective ones of the terminals attached to the remaining lead wires to assure their proper seating on the post terminal and location relative to each other when the insulator sleeve is seated on the post terminal.

2. In a pigtail assembly which includes an end connector having a plurality of insulated lead wires extending therefrom, a terminal attached to the end of each lead wire having a contact for assembly to and retention on a respective ring contact of a multiple ring contact post terminal, an insulator sleeve slidably mounted on a first of the lead wires for isolating the terminal attached to the first lead wire, and a splash guard slidably carried on the lead wires for covering the terminals after attachment to the post terminal, the improvement comprising said insulator sleeve having an integral radial boss adjacent an end of the insulator sleeve which is toward the end connector, said boss having three equally circumferentially spaced guide holes for circumferentially spacing three of the remaining lead wires and the three terminals attached thereto, said insulator sleeve having a pair of circumferentially spaced slots at an end opposite said boss, which are aligned respectively with two of the three guide holes, said spaced slots cooperating with two of the three terminals respectively to assure their proper seating on the post terminal and location relative to each other when the insulator sleeve is seated on the post terminal, and said insulator sleeve having a longitudinal rib to one side of the third guide hole for locating the third of the three terminals.

3. In a pigtail assembly which includes an end connector having a plurality of insulated lead wires extending therefrom, a terminal attached to the end of each lead wire having a contact for assembly to and retention on a respective ring contact of a multiple ring contact post terminal, an insulator sleeve slidably mounted on a first of the lead wires for isolating the terminal attached to the first lead wire, and a splash guard slidably carried on the lead wires for covering the terminals after attachment to the post terminal, the improvement comprising said insulator sleeve having an integral radial boss adjacent an end of the insulator sleeve which is toward the end connector, said boss having a plurality of guide holes for the respective remaining lead wires, and said insulator sleeve having a slot at an end opposite said boss which is aligned with one of said guide holes, said spaced slot cooperating with one of the terminals attached to the remaining lead wires to assure its proper seating on the post terminal and location relative to the other terminals attached to the remaining lead wires when the insulator sleeve is seated on the post terminal.

4. In a pigtail assembly which includes an end connector having a plurality of insulated lead wires extending therefrom, a terminal attached to the end of each lead wire having a contact for assembly to and retention on a respective ring contact of a multiple ring contact post terminal, an insulator sleeve slidably mounted on a first lead wire for telescopically receiving and isolating a first terminal attached to the first lead wire, and a splash guard slidably carried on the lead wires for covering the terminals after attachment to the post terminal, the improvement comprising said insulator sleeve being slidably mounted on the first lead wire by means of a first guide hole which has a snug sliding fit with the first lead wire so that the terminal attachment portion of the first terminal does not vibrate to any appreciable extent when the insulator sleeve is seated, an integral radial boss adjacent an end of the insulator sleeve which is toward the end connector, said boss having a second guide hole outside the insulator sleeve which has a snug sliding fit with a second lead wire for a second terminal so that the terminal attachment portion of the second terminal does not vibrate to any appreciable extent when the insulator sleeve is seated, and said insulator sleeve having a portion engageable with the second terminal when seated to insure proper seating on the second terminal on the post terminal.

* * * * *